United States Patent [19]

Raque et al.

[11] 4,205,503

[45] Jun. 3, 1980

[54] LID CLOSER METHOD AND APPARATUS

[76] Inventors: Glenn F. Raque, 11107 Ainwick Ct.; Edward A. Robinson, 8914 Pine Lake Dr., both of Louisville, Ky.

[21] Appl. No.: 914,435

[22] Filed: Jun. 12, 1978

[51] Int. Cl.[2] ..... B65B 7/28

[52] U.S. Cl. ..... 53/366; 53/300

[58] Field of Search ..... 53/329, 300, 366, 333, 53/334, 486, 287, 374, 387

[56] References Cited

U.S. PATENT DOCUMENTS

| | | | |
|---|---|---|---|
| 3,146,566 | 9/1964 | Roth | 53/374 |
| 3,263,393 | 8/1966 | Weber | 53/486 |
| 3,355,858 | 12/1967 | Jahn | 53/366 X |
| 3,371,465 | 3/1968 | Grant | 53/333 |
| 3,435,588 | 4/1969 | Johnson, Jr. et al. | 53/366 |
| 3,703,067 | 11/1972 | Goodrich et al. | 53/374 |
| 3,866,387 | 2/1975 | Davis | 53/333 X |

*Primary Examiner*—Horace M. Culver

*Attorney, Agent, or Firm*—Edward M. Steutermann

[57] ABSTRACT

This invention provides apparatus for securing a substantially flat lid closure member to an upwardly directed opening of a container partially surrounded by an outwardly directed substantially horizontal base flange means where a peripheral lip is provided around a portion of the outer edge of the base flange and includes a front lip, a rear lip and spaced apart side lips extending generally between the front lip and the rear lip and where the lid member is received within the lip means on the base flange to cover the container opening to retain a selected product within the container. The container is moved on conveyor means in a selected direction along a conveyor path. First side folder means are provided to fold the side lips over the lid. Orbital roller means are connected to shaft means above the conveyor path to rotate in an orbital path about pivot means at a selected speed so that at the bottom of the orbital path, the orbital roller moves in the direction of travel of the container to fold the rear lip inwardly. Roller means are located at substantially the same elevation as the base flange where the container is then passed under the roller means to fold the front lip down onto the lid means.

5 Claims, 7 Drawing Figures

LID CLOSER METHOD AND APPARATUS

BACKGROUND OF THE INVENTION

The present invention relates to an improved method and apparatus for securing a lid to an opening of a container and particularly to containers of the type normally used to contain food products. Such containers are generally made of aluminum or similar metal, or plastic. In some instances, the containers have a substantially flat bottom with upwardly extending sidewall means that terminate to define the open end of the container and are further provided with a base flange extending outwardly from around the opening to the container to receive a lid closure and are further provided with a lip extending upwardly from the flange at the outer edges thereof so that a flat lid can be placed at rest on the base flange and lip turned inwardly to secure the lid.

While other closure arrangements can be provided where a lid is simply glued to an outwardly extending flange, arrangements of the type previously described are particularly useful, and almost necessary in packing food products to prevent unacceptable contamination of the product. Furthermore, equipment to seal packages by folding over an upstanding lip is generally more reliable and less expensive than corresponding equipment adapted to glue a lid in place.

In such arrangements where a lid is placed on the opening of a container, the container travels along a conveyor line where it is first filled with the material to be packaged. The lid is then placed on the container, for example, by devices in accordance with our co-pending application serial No. filed .

The container continues to travel along the conveyor to a station where the lid is secured in place by folding the lips over the lid and the finished package is then ready for shipment, or in some cases freezing.

One previous arrangement for securing lids on such containers is shown in U.S. Pat. No. 3,263,393, Weber, where an arrangement utilizing multiple rollers at various angles of vertical and horizontal inclination are utilized to fold the lip over the lid and secure the lid. While such arrangements are generally satisfactory in application, the equipment is cumbersome and expensive. Furthermore, it is necessary to carefully maintain the alignment of the rollers used in such arrangements. Since such arrangements are particularly susceptable to wear, and misalignment is a frequent problem, maintenance costs associated with such devices are significant.

SUMMARY OF THE INVENTION

The present invention provides an improved method and apparatus for securing flat lid members within a cooperative lip of a container while the container and the assembled lid member are continuously moved in one direction along a conveyor means.

Devices in accordance with the present invention are straightforward and economical in construction and require less maintenance attention than previous devices designed to accomplish similar purposes.

Furthermore, the present invention provides means for assuring proper positioning of the lid during the closing operation which has heretofore not been available.

Other features of the present invention will become obvious to those skilled in the art upon reading the disclosure of one illustration of an apparatus in accordance with the present invention as set forth hereinafter.

Briefly, the present invention provides a method and apparatus for securing a substantially flat lid closure member to an upwardly directed opening of a container where the opening is surrounded by an outwardly directed substantially horizontal base flange means where the outer end of the base flange is integrally connected to an upwardly extending peripheral lip where the peripheral lip substantially surrounds the base flange and includes a front lip, a rear lip, with spaced apart side lips extending between the front lip and the rear lip and where the periphery of the lid member is of substantially the same geometric configuration as the outer edge of the flange and where the lid is placed on the horizontal base flange to cover the open end of the container to retain a selected product within the container and where the container is moved on a conveyor means in a selected direction of travel along a selected conveyor path and where first folder means are provided in cooperative relation with the conveyor means on the outside of each of the side lips and adapted to fold the side lips inwardly over the edges of the lid, and orbital roller means cooperatively disposed with respect to the conveyor means to be rotated in the direction of travel of the container to engage the rear lip of the container and fold the rear lip inwardly over the rear edge of the lid and roller means provided at substantially the same elevation as the base flange to engage the front lip as the container passes the orbital roller means to fold the front lip inwardly onto the front edge of the lid means and to further urge the side flanges and rear flanges against the lid as the container is moved along the conveyor.

BRIEF DESCRIPTION OF THE DRAWINGS

Referring now to FIG. 1, devices in accordance with the present invention are provided to secure a lid 1 to a container 2 having an open end 3. Container 2 is provided with an outwardly directed base flange 6 surrounding opening 3 and an upwardly extending lip 4 is provided around the outer edge of flange 6 to be folded over the edges of lid 1 when the lid is in place on flange 6. In the example shown, container 2 can be received within a conveyor frame 7 which is moved along a selected path defined by a conveyor means described hereinafter by means of a chain 11 secured to frame 7 by means of a fastener 12. Frame 7 is provided with a platen surface 8 at the top of the frame to receive base flange 6 of container 2. A runner 9 can be provided to extend outwardly from the sides of frame 7 to engage a support member of the conveyor, (as described hereinafter) to guide frame 7 along a selected path.

Figures 1, 2:
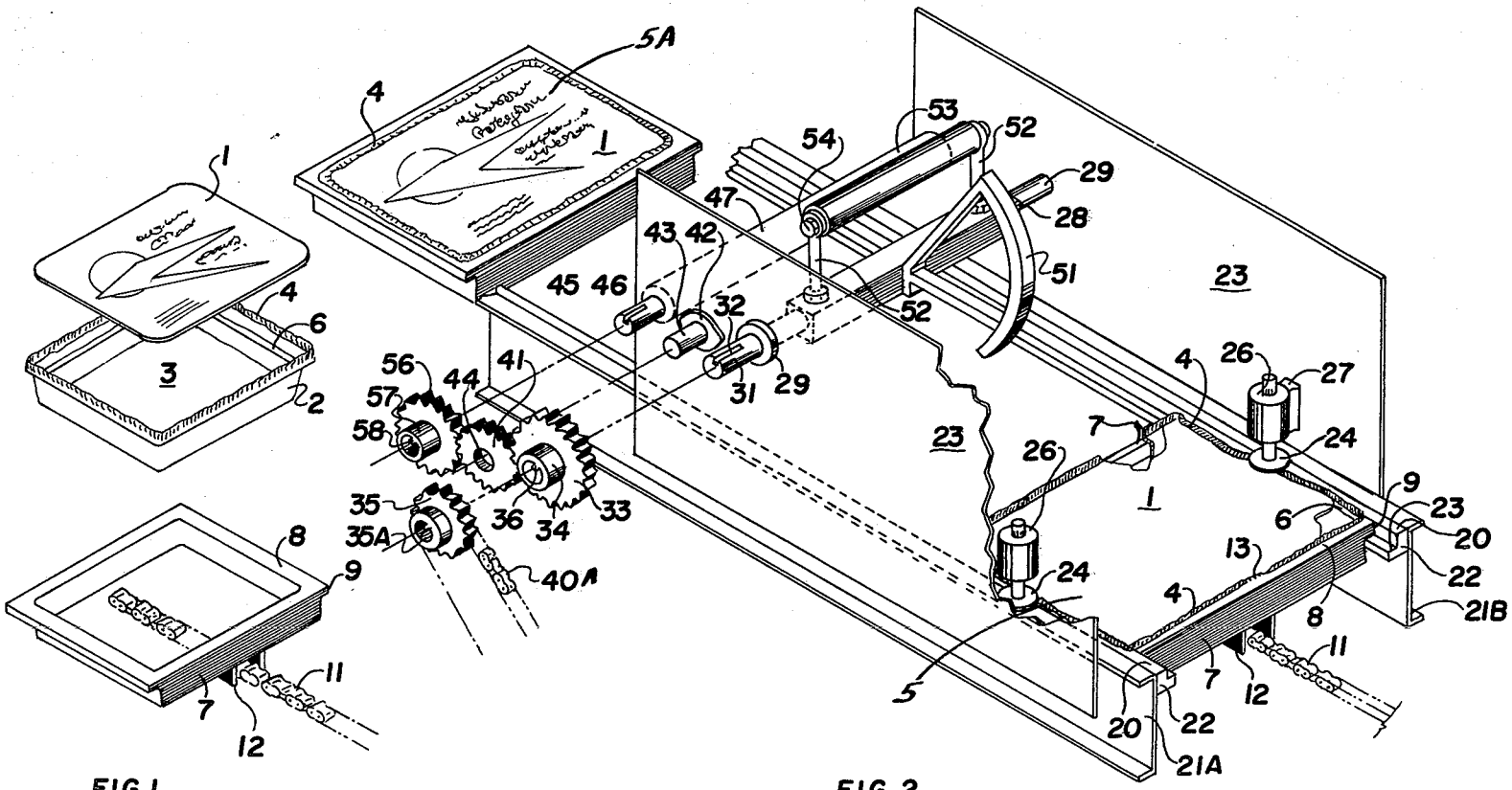
FIG. 1 is an exploded schematic illustration of the assembly process in closing a typical container.
FIG. 2 is a perspective partially exploded view of one arrangement in accordance with the present invention.

With reference to container 2, opening 3 is provided to receive the article to be packaged and, as previously discussed, a base flange 6 is provided to extend generally horizontally outwardly from container 2, around opening 3, and an upwardly extending lip 4 is provided around the periphery of flange 6. After the material to be packaged is received in container 2, a substantially flat lid 1, is placed on flange 6 within the opening defined by upstanding lip 4 and, as described hereinafter, upstanding lip 4 is then folded inwardly over the edges of lid 1 to secure the lid and form the finished package.

Lid 1 can be placed on flange 6 by various means, including the method and apparatus shown in our U.S. Pat. No. 4,102,113.

Referring now to FIG. 2, which illustrates one arrangement and method within the scope of the present, spaced apart support means 21A and 21B are provided to define the sides of a conveyor mechanism where frame members 21A and 21B are in generally parallel relation and container frame 7 is passed along the path defined between frame members 21A and 21B. As shown in FIG. 2 notched guides 22 are provided on each of the frame members 21A, 21B and include a bearing surface 23 to engage the underside of runners 9 of frame members 7 to guide frame member 7 between frame members 21A and 21B along the conveyor path defined thereby. In the arrangement shown, a package 5 is shown in the first stage of closing with lid 1 in position and a finished package 5A is shown at the exit from the conveyor.

More particularly with respect to package 5, lid 1 has been placed on base flange 6. In the arrangement shown, segment 13 of the rear portion of flange 4 has been crimped inwardly, as shown in the device illustrated in our U.S. Pat. No. 4,102,113.

As shown, wall members 23 can be provided at the outer edges of frame members 21A, 21B to support the elements of the closure devices as described hereinafter. As package 5 is moved along the conveyor path, the sides of lip 4 are first folded over lid 1. In this regard, journal means 26 are secured to each of the wall members 23 by means of a bracket 27 where journal means 26 are adapted to rotably receive a disc 24 where the diameter of discs 24 is selected so that the outer periphery of the discs engage the side portions of lip 4, as shown. Advantageously, the lower edge of each of the discs 24 can be inwardly chamfered (not shown) so that the discs engage lips 4 so the lips are folded inwardly by the chambered portions of discs 24 as frame 7 conveys container beneath the discs 24. The elevation of discs 24 can be selected so that the discs are located only slightly above the elevation of platen surfaces 8 of frame 7.

The next procedure can be the folding of the rearmost portion of lip 4 and in this regard a rotatable shaft 29 is provided and is journaled at opposite ends in walls 23. Brackets 52 are provided at opposite ends of shaft 52 to extend radically outwardly from shaft 29 in parallel relation where the distance between bracket 52 is greater than the width of frame 7. Each bracket 52 includes a journal 54 at the ends thereof adapted to rotatably receive a roller 53 so that roller 53 moves in an orbital path with respect to shaft 29 disposed in rotatable journals 54. The width of roller 53 is, advantageously, slightly greater than the width of the rear portion of flange 4. Advantageously, bracket 52 and roller 53 are sized so that the outer periphery of roller 53 engages the rear edge of lip 4 to turn lip 4 inwardly and press the rear edge of lip 4 into lid 1 against the surface of platen 8 as described hereinafter.

Guide 51, for example a crescent bracket can be provided and connected to shaft 29 for rotation therewith. Guide 51, as shown, rotates with shaft 29 and the diameter of guide 51 is selected so the periphery of 51 engages the upper surface of lid 1 as package 5 moves beneath shaft 29, as described hereinafter. Shaft 29 extends through a journal 31 in one of the walls 23, as shown, and includes a key slot 32. Shaft 29 is adapted to receive a gear wheel 33 and a sprocket 40 each including key members 36. In accordance with one feature of the present invention, shaft 29 is driven at a selected speed of rotation and in the arrangement shown, shaft 29 is driven by sprocket 40 which is driven by chain 40A by a drive means (not shown) in response to movement of chain 11 as described hereinafter. Movement of chain 40A rotates shaft 29 and therefore wheel 33 at a selected speed synchronized with the movement of packages 5 and 5A along frame members 21A and 21B, so that bracket 51 and roller 53 move in the direction of travel of frame 7 when in contact with package 5.

A stub shaft 43 can be provided and journalled for rotation in a journal 42 as shown where shaft 43 receives a gear wheel 41 which, advantageously, meshes with gear 33 for rotation therewith.

In accordance with another feature of the present invention, roller means are provided to fold the front edge of lip 4 inwardly over lid 1. In this regard, a roller 47 is provided further along the conveyor path from shaft 28. Roller 47 is longer than the width of container 2 and is located transverse to the direction of travel of container 2 and is disposed of so the lower edge of roller 47 just clears the upper surface of platen 8 as frame 7 passes thereunder and roller 47 engages the front edge of lip 4 and turns the edge inwardly over lid 1. Roller 47 can be carried on a shaft 46 adapted to receive a gear member 56 which meshes with gear 41 and is driven thereby so the peripheral speed of roller 47 is approximately equal to the linear speed of movement of frames 7 along the path defined between frame members 21A and 21B and where gear 41 is selected to provide the desired speed of rotation of gear wheel 56 and the proper direction of rotation.

Figure 3A:
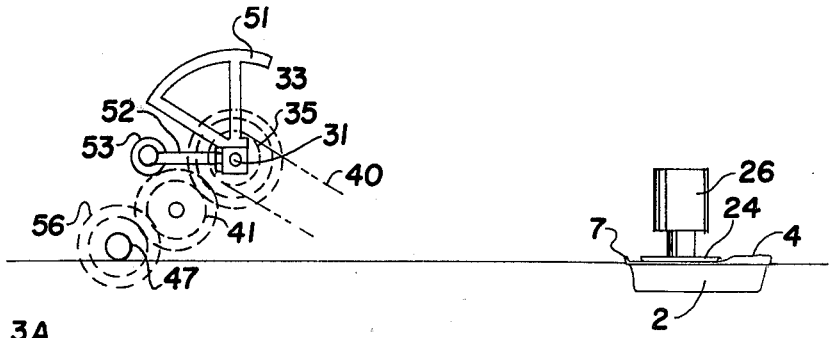
FIGS. 3A–3E are schematic illustrations of the operation of the apparatus shown in FIG. 2.

Referring now to FIGS. 3A–3E which schematically illustrate the operation of devices in accordance with the present invention, and referring particularly to FIG. 3A, a container 1 is shown in a position where the discs 24 are in process of turning the sides of lip 4 inwardly in approximately the same position as package 5 illustrated in FIG. 2.

Figure 3B:
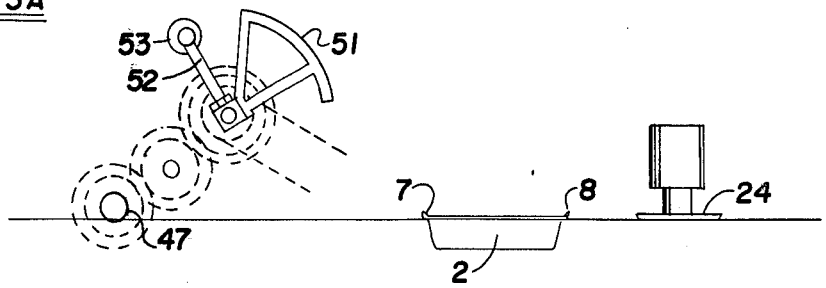

Referring now to FIG. 3B, the package 1 has passed completely under discs 24 and is approaching shaft 29.

Figure 3C:
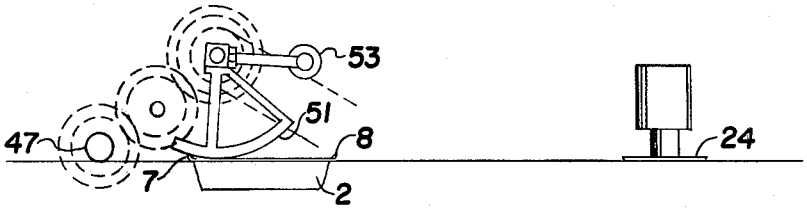

In FIG. 3C, the package is located beneath shaft 29, where bracket 51 is in position to engage lid 1 to hold lid 1 securely in position on base flange 6 while roller 53 is approaching the rear edge of lip 4.

In the example shown, the speed of rotation of shaft 29 is advantageously interrelated with the rate of travel of, and spacing between, frames 7 so that roller 53 strikes the rear side of lip 4 of every container 2.

Within the scope of the present invention, various arrangements can be utilized to provide the necessary timing and is the example shown, drive chain 40A can be interrelated with the drive means (not shown) which drives chain 11 so that the speed of chain 40A and 11 are likewise interrelated. Thus an increase or decrease in speed of chain 11 results in a proportional change in speed of chain 40A and speed of rotation of shafts 29 and 46.

Also in the arrangement shown it is desirable that the linear speed of the periphery of roller 53 be in excess of the linear speed of the rear side of lip 4 at the time roller 53 contacts lip 4 so that lip 4 is wiped forward over lid 1. In the example shown, chain 40A can be driven at a speed to provide two rotations of shaft 29 for every advance of a container 2, so roller 53 makes two complete transverses, for each time it strikes a lid 4 so that the effective linear velocity of the lip of roller 53 is twice the velocity of travel of frame 7.

Gears 41 and 53 can be selected so that roller 47 is rotated at a selected speed but advantageously roller 47 is rotated at a speed when the linear velocity of the periphery is equal to or slightly greater than the speed of travel of frame 7.

Figure 3D:
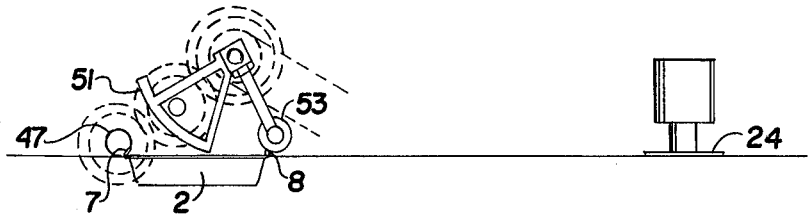

FIG. 3D illustrates the arrangement where shaft 29 has rotated orbital roller 53 to a position to engage the rear portion of lip 4 and the front edge of lip 4 has reached roller 47 to be being turned inwardly over lid 1.

Figure 3E:
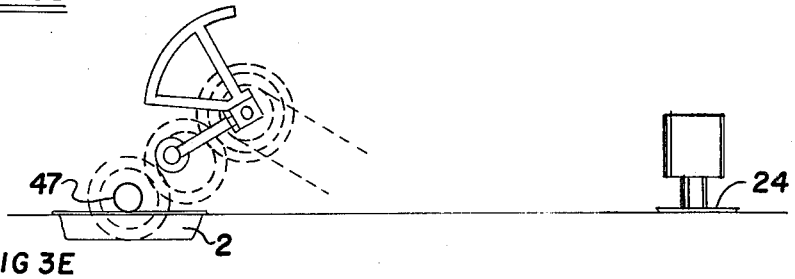

The process continues until, as shown in FIG. 3E, the positions are illustrated where shaft 29 has rotated roller 53 out of position with respect to container 1 and roller 47 is finally securing side portions of lip 4 in position against the upper surface of lid 1.

The foregoing is but one example of an arrangement in accordance with the present invention and various other arrangements also within the scope of the present invention will occur to those skilled in the art upon reading the disclosure set forth hereinbefore.

The invention claimed is:

1. A device for securing a substantially flat lid to an upwardly directed opening of a container where the container opening is substantially surrounded by an outwardly directed substantially horizontal base flange means with an upwardly extending peripheral lip provided around a portion of the base flange where the peripheral lip includes a front lip, a rear lip and general parallel side lips where the lid member is received inside the lip means and rests on the base flange to cover the container opening to retain a selected product in the container including:

(a) conveyor means to receive said container and adapted to move the container in a selected direction;

(b) at least two first folder means with at least one of said first folder means disposed on opposite sides of said conveyor means to contact each of said side lips as said container is moved by said conveyor to fold said side lips inwardly over the side of said lid;

(c) rotatable shaft means located in spaced relation above said conveyor means and adapted to be rotated about an axis transverse to the direction of travel of said container means, a pair of spaced parallel first arm means fixed at a first end to said shaft means to extend radially outwardly therefrom for rotation with said shaft means, orbital roller means rotatably secured between second ends of said bracket means and where the length of said bracket means is selected to cause said orbital roller to engage the upper surface of said container when said orbital roller means is at the bottom of its orbit and where said shaft means is rotated in a direction so that the orbital roller at the lower segment of the arc of travel of said orbital roller means moves in the direction of travel of said conveyor means and wherein said orbital roller means is adapted so the orbital roller engages the rear side of said rear lip of said container to fold said rear lip forwardly over the rear edge of said lip means as said container passes under said shaft; and, (d) semi-circular bracket means connected to said shaft at a location between said first arm means and having a diagenerally equal to the diameter of the arc of travel of said orbital roller for rotation with said shaft in advance of said orbital roller so said bracket contacts said lid means prior to contact between said orbital roller and said rear lip so said bracket urges said lid toward said base flange; and, (e) power means to rotate said shaft at selected speed of rotation;

(f) second roller means disposed above said conveyor means for rotation about an axis generally transverse to the direction of travel of said conveyor means where the bottom edge of said second roller means moves in the direction of travel of said conveyor means and is adapted to fold the front lip of said container backwardly, relative to the direction of travel of said container, over the front edge of said lid means.

2. The invention of claim 1 wherein said first folder means includes disc means disposed for rotation about a vertical axis where the disc is disposed so an outer edge of the disc contacts the side lip means of the container to fold the side lip means inwardly over the side edge of said lid means.

3. The invention of claim 1 wherein said orbital roller means is wider than said container means so said orbital roller contacts the rear lip of the container along the entire length thereof.

4. The invention of claim 1 wherein the linear peripheral speed of said orbital roller is greater than the speed of travel of said conveyor.

5. The invention of claim 1 wherein said shaft means is rotated at a speed whereby the linear speed of rotation of said orbital roller is in excess of the linear speed of said conveyor means.

* * * * *